US006273043B1

(12) United States Patent
Barton

(10) Patent No.: US 6,273,043 B1
(45) Date of Patent: Aug. 14, 2001

(54) MOUNTING PLATE AND ROCKER ARM ASSEMBLY

(76) Inventor: Raymond A. Barton, 343 Belle Alto Rd., Wernersville, PA (US) 19565

( * ) Notice: Subject to any disclaimer, the term of this patent is extended or adjusted under 35 U.S.C. 154(b) by 0 days.

(21) Appl. No.: 09/526,900

(22) Filed: Mar. 16, 2000

(51) Int. Cl.[7] ..... F01L 1/18
(52) U.S. Cl. ..... 123/90.41; 123/666; 123/90.16
(58) Field of Search ..... 123/90.16, 90.27, 123/90.39, 90.4, 90.41, 90.61, 198 F, 666

(56) References Cited

U.S. PATENT DOCUMENTS

| | | | | |
|---|---|---|---|---|
| 1,559,694 | | 11/1925 | Harper, Jr. . | |
| 2,401,480 | | 6/1946 | Halliday | 123/90 |
| 2,515,347 | | 7/1950 | Jameson | 123/90 |
| 2,898,898 | | 8/1959 | Burch | 123/52 |
| 4,380,219 | * | 4/1983 | Walsh | 123/90.16 |
| 4,423,709 | * | 1/1984 | Arrieta | 123/198 F |
| 4,430,969 | | 2/1984 | Holtzberg et al. | 123/90.39 |
| 4,440,121 | * | 4/1984 | Clancy et al. | 123/90.39 |
| 4,491,099 | * | 1/1985 | Bonvallet | 123/90.27 |
| 4,856,467 | * | 8/1989 | Kronich | 123/90.41 |
| 4,986,227 | * | 1/1991 | Dewey, III | 123/90.16 |
| 5,038,726 | * | 8/1991 | Pryba | 123/90.41 |
| 5,060,606 | * | 10/1991 | Hubbard | 123/90.39 |
| 5,596,958 | | 1/1997 | Miller | 123/90.23 |
| 5,645,025 | * | 7/1997 | Caya et al. | 123/90.41 |
| 6,155,222 | * | 12/2000 | Isoshima et al. | 123/90.41 |
| 6,178,936 | * | 1/2001 | Kouchi et al. | 123/90.41 |

* cited by examiner

*Primary Examiner*—Teresa Walberg
*Assistant Examiner*—Fadi H. Dahbour
(74) *Attorney, Agent, or Firm*—Synnestvedt & Lechner LLP

(57) ABSTRACT

A plate for mounting a rocker arm assembly on an internal combustion engine having hemispherical combustion chambers is disclosed. The plate has a lower surface which mounts to the head of the engine. First and second surface portions are arranged in parallel, spaced apart relation opposite the lower surface. The first and second surface portions provide mounting surfaces for individual rocker arm stands on which the rocker arms are rotatably mounted. The stands are oriented to extend at an angle to the plane of the plate by angularly orienting the first and second surface portions. Mounting the rocker arms in this manner allows them to engage the push rods and valve stems at respective points of contact which remain over the centerlines of the push rods and valve stems and push true along the line of motion of these components. This arrangement eliminates side loads on the push rods and valve stems and results in increased engine performance.

34 Claims, 4 Drawing Sheets

FIG.1
PRIOR ART
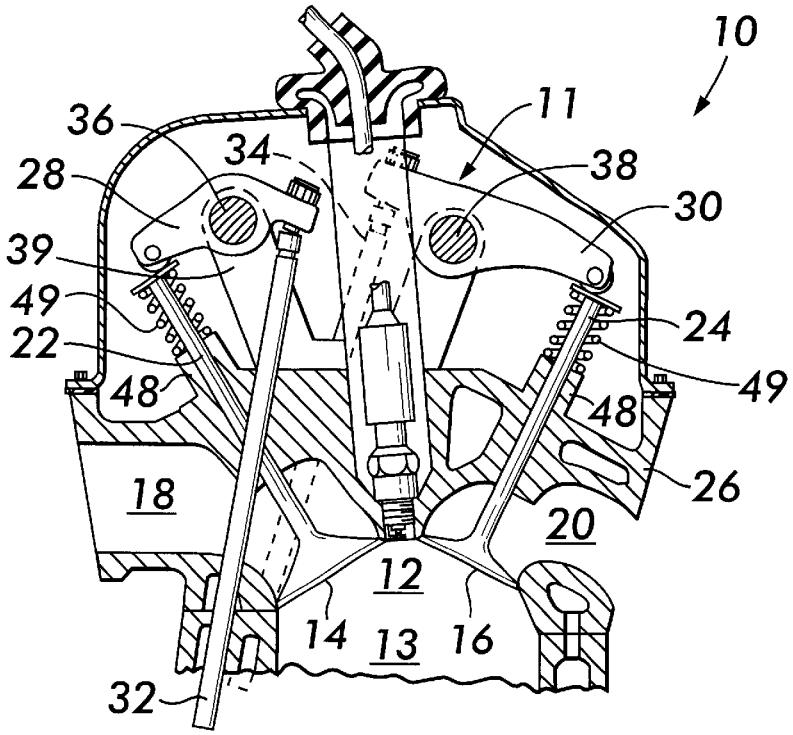
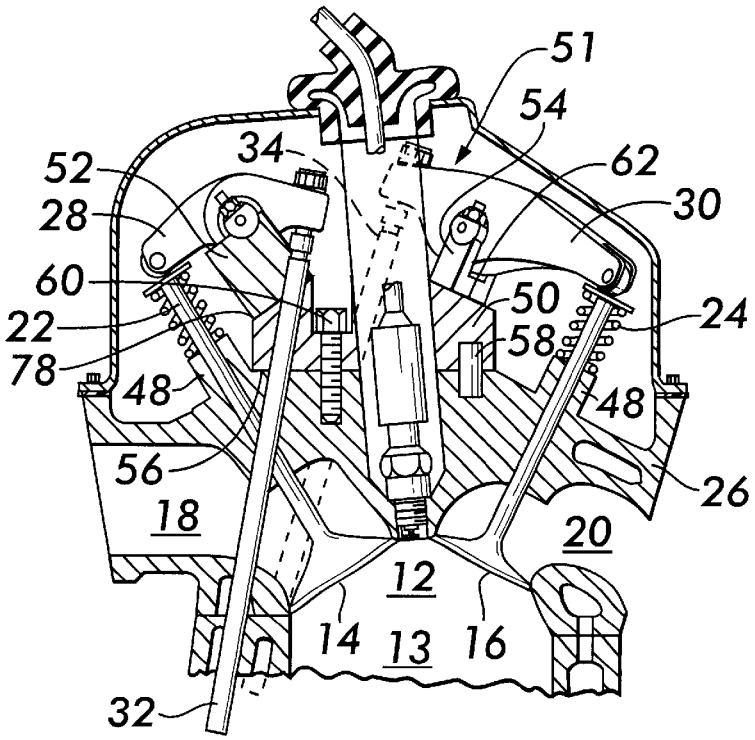
FIG.2

FIG.1A
PRIOR ART
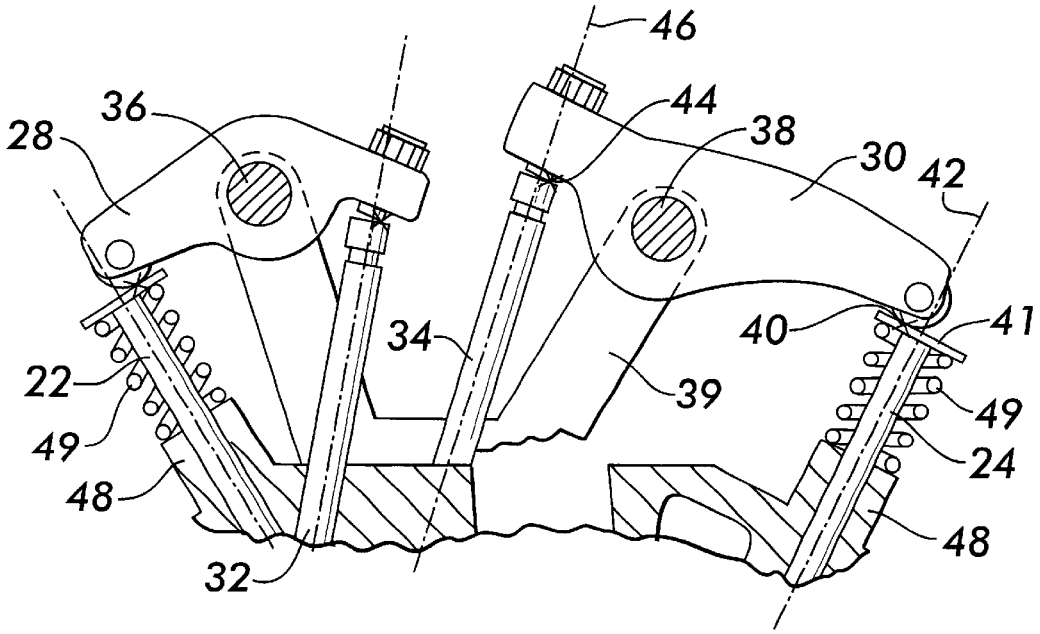
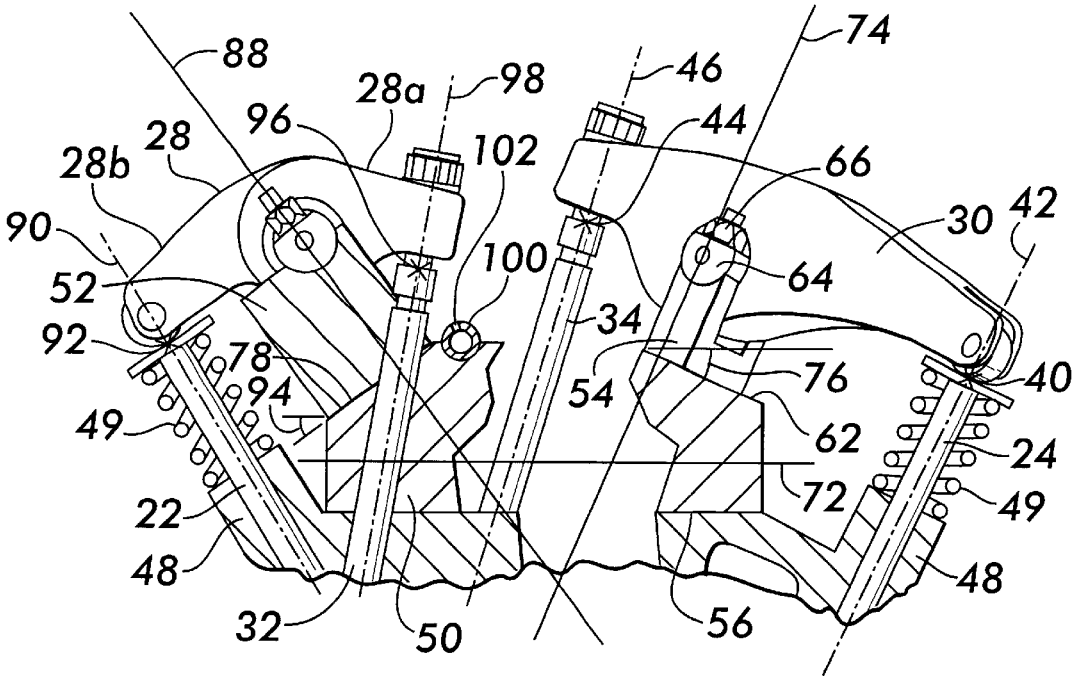
FIG.2A

FIG.4
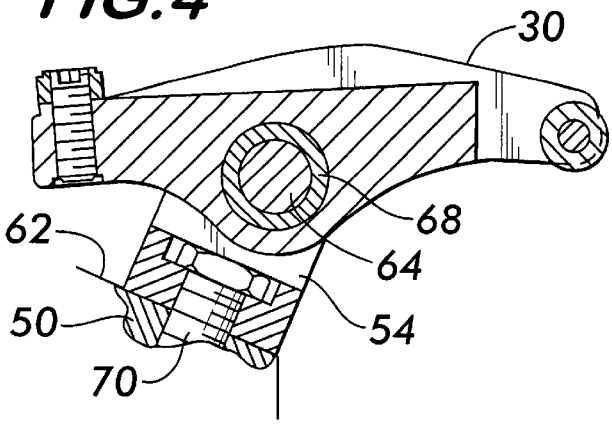
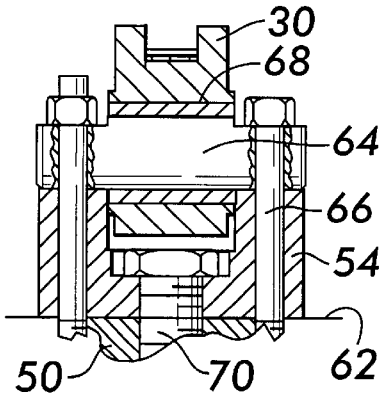
FIG.5
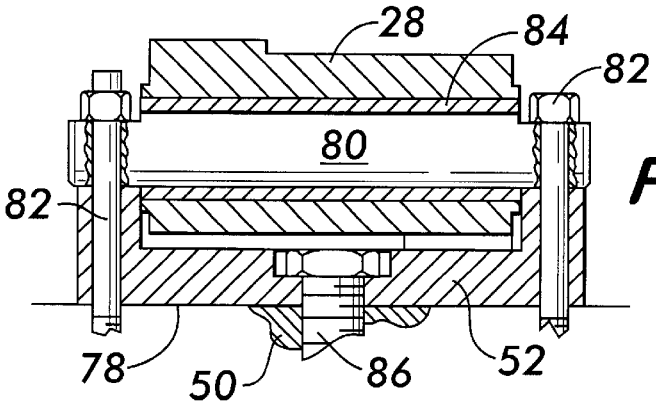
FIG.6
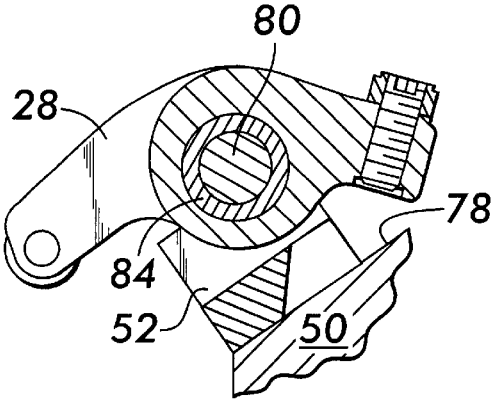
FIG.7
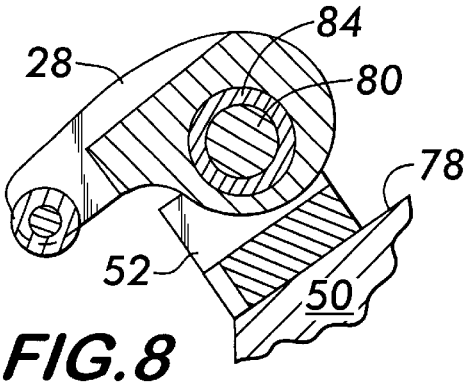
FIG.8

MOUNTING PLATE AND ROCKER ARM ASSEMBLY

FIELD OF THE INVENTION

This invention relates to a plate for mounting rocker arms on internal combustion engines, and especially on engines having hemispherical combustion chambers.

BACKGROUND OF THE INVENTION

The following background information describes a single cylinder typically in a multiple cylinder engine, it being understood that other cylinders comprising the engine are identical and that the description applies equally well to them.

Internal combustion engines, as illustrated at 10 in FIG. 1, having hemispherical combustion chambers such as 12 atop each cylinder 13 have evolved in the quest for improved performance demanded in the racing environment. Hemi-engines, as they are more commonly known, find particular application in drag racing, where the engine is required to run at 8,600 rpm or better and produce tremendous power for a short period of time to propel the dragster at speeds in excess of 150 mph over the standing quarter mile.

Hemi-engines are preferred for racing because they are able to produce significantly more horsepower than a conventional engine for a given engine displacement. One reason for this is the placement of the intake valve 14 and exhaust valve 16 in line with the intake port 18 and exhaust port 20 of cylinder 13 which provides for a more efficient cross flow of the combustion gases through the engine.

While the hemi-engine does produce more horsepower, the cross-flow valve arrangement in combination with the hemispherical combustion chamber 12 requires that the valve stems 22 and 24 for the cylinder extend angularly from the head 26, as illustrated in FIG. 1. Rocker arms 28 and 30 associated with the cylinder 13 must be arranged to accommodate this valve stem geometry, as well as the geometry of the push rods 32 and 34 (including their lifters, not shown) which are driven from a common cam shaft (not shown), and this requirement poses difficulties in racing engine design. The difficulty is particularly acute when an existing engine, for example, the well known Chrysler 426 engine, is converted to a hemi-engine for racing use since many of the parameters affecting the geometry of the push rods and valve stems, such as the location of the cam shaft and the angle of the lifter bores (which permit the push rods to extend through the engine block to the rocker arms) are fixed and cannot be easily changed to provide a more advantageous geometrical relationship between the rocker arms and the valve stems and push rods. The traditional solution has been to arrange the rocker arms on a pair of parallel, spaced apart shafts 36, 38 arranged atop the hemi-engine head forming a stock rocker arm assembly 11. As shown in FIG. 1, the rocker arms 28 for the intake valves 14 are arranged on the common shaft 36. The rocker arms 30 for the exhaust valves 16 are arranged on a common shaft 38. Shafts 36 and 38 are supported by a plurality of individual bearings such as 39 which are bolted at points along the length of the head 26.

This common shaft arrangement for the stock rocker arm assembly 11 is disadvantageous because it is difficult to arrange the rocker arms 28 and 30, so that the point of contact between them and their respective valve stems 22 and 24 is maintained substantially coincident with the centerline of each valve stem during the rotation of the rocker arm. This is also true for the push rods 32 and 34. The contact point between the rocker arm and the push rod is not maintained coincident with the center line of the push rod.

The undesired relationship between the contact point and the valve stem centerline is illustrated in FIG. 1A, where the contact point 40 is seen to be displaced from the centerline 42 of the valve stem 24. A similar relationship occurs between the contact point 44 and the centerline 46 of the push rod 34.

When the contact point between the rocker arm and the valve stem is displaced from the centerline of the valve stem, the rocker arm does not push true along the line of motion of the valve. Significant side forces are created which impose undesired bending stresses on the valve stem and valve lifters and also cause increased friction between the valve stem and valve guides 48. Similarly, when the contact point between the push rod and the rocker arm is not substantially coincident with the centerline of the push rod, the push rod is subjected to significant side forces which increase the stresses on the push rods and the tappets.

When significant side loads are present in the elongated, reciprocating components, such as the valve stems and push rods, these components must be more robustly constructed to withstand the increased stresses, which means the components are heavier than they need be if the side loads were not present. Heavier components cannot accelerate as rapidly, thus, decreasing the speed at which they can reciprocate and inhibiting the engine from achieving its maximum rpm in the shortest possible time as well as limiting the maximum rpm. The side loads also cause additional friction between the relatively moving parts such as the valve stems and valve guides 48. This friction limits the speed at which the parts can move, thereby limiting the maximum engine speed. The friction also results in increased wear, necessitating the more frequent replacement of worn parts. Furthermore, at the high speeds which the various components move when the engine is turning maximum rpm, there is a much greater chance that valve stems or push rods could become bent by the side loads. This could lead to catastrophic failure of the engine.

The unfavorable geometry between the rocker arms, valve stems and the push rods in the stock rocker arm assembly 11 will also prevent the maximum rocker arm motion from being developed to enable the valves to operate optimally and obtain maximum engine performance. Stock rocker arms as used in the prior art assembly tend to run off of the valve stem and contact the retainer plate 41 (see FIG. 1A) long before optimal valve operation is reached. If the stock rocker arms are set up so that the rocker arm will not run off of the valve stem, the push rod angles are so severe that the push rods tend to contact the engine block. Furthermore, the unfavorable geometry will prevent taking full advantage of the rocker arm ratio, as the full effect of the ratio in moving the valves through a greater distance than the push rods move will be lessened in proportion to the angles between the various components.

Another disadvantage which results from the poor valve geometry associated with the stock rocker arm assembly is that the cam parameters, such as the duration of lift, lift rate and total lift of the valves, cannot be optimized to maximize the power output of the engine. The cam parameters are limited by the geometry of the push rods valve stems due to the side loads which are developed because the rocker arms do not push true along the centerline of the push rods and valve stems. When aggressive cam ramps which move the push rods at a relatively high lift rate are used with the stock rocker arm assembly according to the prior art, the side loads tend to severely over stress the parts and the parts fail, often with catastrophic consequences to the engine.

Yet another disadvantage of the common shaft arrangement for mounting the rocker arms is that to change a valve spring 49 for a particular valve, all of the rocker arms on the common shaft must be removed whether or not the springs related to their valves need replacement or not. Individual valve springs must be changed quite often on racing engines and it becomes a very tedious and time consuming task if all of the rocker arms on one shaft must be removed and readjusted to replace one spring. The time factor can become important if there is not enough time between heats to change a defective spring because all of the rocker arms must be removed, reinstalled and readjusted.

There is clearly room for improvement in the mounting of rocker arms on hemi-engines which allows rocker arms to be mounted individually on the head. By mounting the arms individually, more favorable geometry can be established to position and maintain the point of contact of the rocker arm in substantial coincidence with the centerline of the valve stem or the push rod. This will permit the arm to push true along the line of motion of the components and not introduce significant side loads in the components. Better geometry will also allow cam parameters to be established which will maximize engine performance. Finally, individually mounted rocker arms will allow components associated with a particular cylinder, such as the valves, valve guides or valve springs, to be changed relatively quickly without disturbing the rocker arms associated with the other cylinders.

SUMMARY AND OBJECTS OF THE INVENTION

The invention concerns a mounting for securing a plurality of rocker arm stands to the head of an internal combustion engine to form a rocker arm assembly. Each rocker arm stand has an elongated rocker arm rotatably mounted thereon and the engine has a plurality of push rods each having a centerline extending angularly from the head. Each push rod interengages one end of a respective rocker arm at a point of contact.

The mounting comprises a plate having a lower surface interengagable with the head and a first surface portion arranged opposite to the lower surface. The rocker arm stands are mountable on the first surface portion and each projects along respective axes extending substantially parallel to the angularly extending centerlines of the push rods. The point of contact between a rocker arm and a push rod is substantially coincident with the centerline of the push rod substantially throughout the motion of the rocker arm.

Preferably, the first surface portion is angularly oriented with respect to the plane of the plate, and the rocker arm stands are mountable substantially perpendicularly to the first surface portion. The preferred angular orientation of the first surface portion is between about 20° and about 40° and, most preferably, at an angle of about 23° to the plane of said plate.

For each push rod, the engine also has an associated valve with a valve stem which also has a centerline extending angularly from the head. Each valve stem interengages the other end of a respective rocker arm at a second point of contact, this second point of contact being substantially coincident with the angularly extending centerline of each valve stem substantially throughout the motion of the rocker arm.

Valves are normally used in pairs on an engine, there being an intake and an exhaust valve for each combustion chamber. To accommodate this configuration, the mounting plate further comprises a second surface portion positioned on the plate opposite to the lower surface and in spaced relation to the first surface portion. The engine has a plurality of second valves, and, thus, a plurality of second valve stems, each of which has a centerline extending angularly from the head. A plurality of second rocker arm stands are mountable on the second surface portion and project along respective axes extending substantially parallel to the angularly extending centerlines of the second valve stems. A plurality of second elongated rocker arms are rotatably mounted, one on each of the second rocker arm stands. Each of the second valve stems interengages one end of a respective second rocker arm at a third point of contact. The third point of contact is substantially coincident with the centerline of each second valve stem substantially throughout the motion of the second rocker arm.

Preferably, the second surface portion is angularly oriented with respect to the plane of the plate at an angle between 20° and 40° and, most preferably, at about 35°. The second rocker arm stands are preferably mounted substantially perpendicularly to the second surface portion.

To actuate the second valves, the engine further comprises a plurality of second push rods each having a centerline extending angularly from the head. Each of the second push rods interengages the other end of one of the second rocker arms at a fourth point of contact. The fourth point of contact is substantially coincident with the centerline of the second push rod substantially throughout the motion of the second rocker arm.

The various components of the rocker arm assembly described above, i.e., the rocker arms, the push rods and the valve stems, require constant lubrication. In order to provide this lubrication, the plate further comprises an oil distribution tube. The oil distribution tube is mounted on the plate adjacent to one of the first and second surface portions beneath the rocker arms. The oil distribution tube carries lubricating oil under pressure and has at least one, but preferably a plurality of apertures, each one being oriented to direct a stream of lubricating oil to lubricate the point of contact between a push rod and a rocker arm.

It is an object of the invention to provide a mounting for a rocker arm assembly on a hemi-engine which allows the rocker arms to be individually mounted on respective rocker arm stands.

It is another object of the invention to provide a mounting for a rocker arm assembly which improves the geometrical relationship between the rocker arms and the valve stems by positioning and maintaining the point of contact between each rocker arm and its associated valve stem substantially coincident with the centerline of the valve stems.

It is yet another object of the invention to provide a mounting for a rocker arm assembly which improves the geometrical relationship between the rocker arms and the push rods by positioning and maintaining the point of contact between each rocker arm and its associated push rod substantially coincident with the centerline of the push rod.

It is still another object of the invention to provide a mounting for a rocker arm assembly which minimizes or eliminates side loads imposed on the valve stems and push rods.

It is again another object of the invention to provide a mounting for a rocker arm assembly which allows the cam parameters to be established to produce maximum engine power and not be limited by valve stem or push rod geometry.

It is yet again another object to the invention to provide a mounting for a rocker arm assembly which allows an individual rocker arm to be removed to effect repair to a cylinder without disturbing the rocker arms for other cylinders.

It is still another object of the invention to provide a mounting for a rocker arm assembly which permits maximum rocker arm motion to be developed.

It is again another object of the invention to provide a mounting for a rocker arm assembly which permits the rocker arm ratio to be fully utilized.

These and other objects of the invention will become apparent from a consideration of the following drawings and detailed description of the invention.

BRIEF DESCRIPTION OF THE DRAWINGS

FIG. 1 is a partial cross-sectional view of a hemi-engine showing the combustion chamber and the head with the rocker arms mounted on the head in a stock rocker arm assembly according to the prior art;

FIG. 1A is a detailed view on an enlarged scale of the prior art rocker arm mounting arrangement shown in FIG. 1;

FIG. 2 is a partial cross-sectional view of a hemi-engine showing the combustion chamber and the head with the rocker arms mounted on the head according to the invention;

FIG. 2A is a detailed view on an enlarged scale of the rocker arm mounting arrangement according to the invention shown in FIG. 2;

FIG. 4 is a cross-sectional view of a rocker arm stand taken along line 4—4 of FIG. 3;

FIG. 5 is a cross-sectional view of a rocker arm stand taken along line 5—5 of FIG. 3;

FIG. 6 is a cross-sectional view of a rocker arm stand taken along line 6—6 of FIG. 3;

FIG. 7 is a cross-sectional view of a rocker arm stand taken along line 7—7 of FIG. 3; and FIG. 8 is a cross-sectional view of a rocker arm stand taken along line 8—8 of FIG. 3.

DETAILED DESCRIPTION OF THE PREFERRED EMBODIMENT

Figure 3:
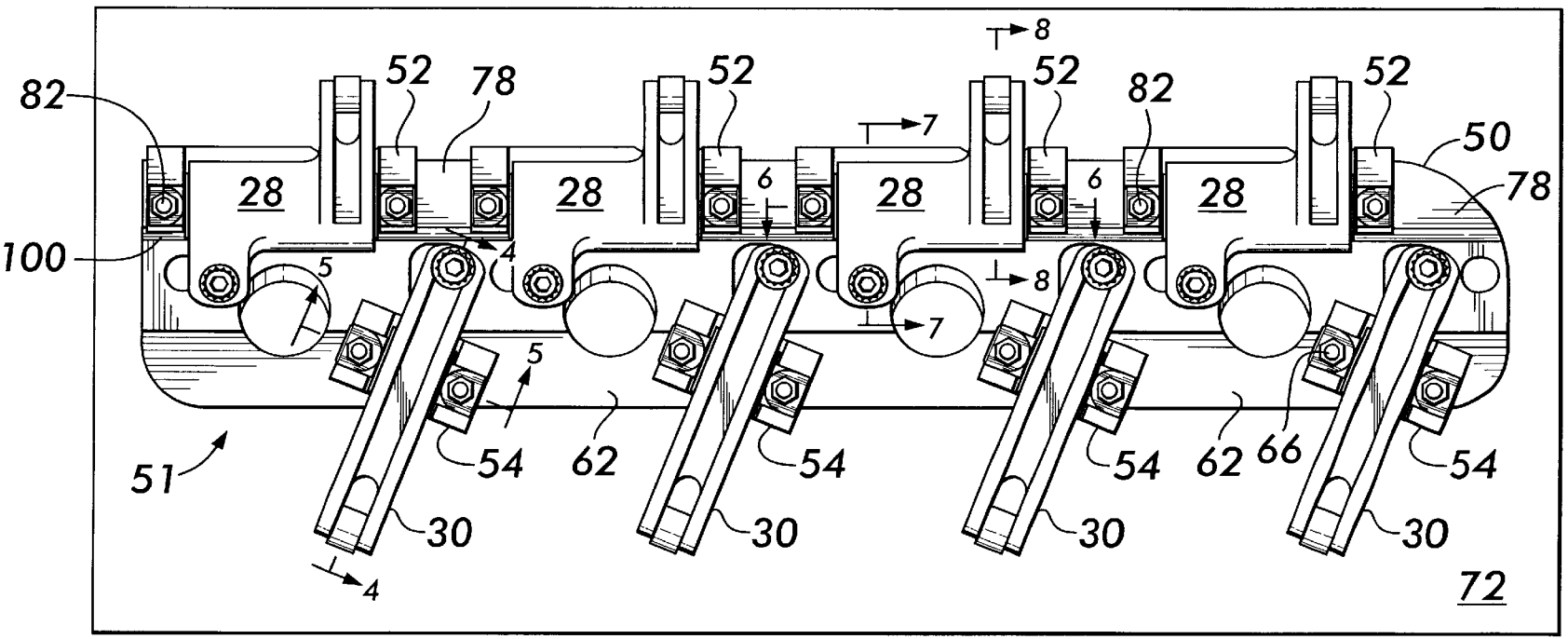
FIG. 3 is a plan view of a rocker arm assembly according to the invention mountable onto the head of an engine.

FIGS. 2 and 3 show the mounting plate 50 for mounting rocker arm stands 52 and 54 onto the head 26 of a hemi-engine 10 to form a rocker arm assembly 51 according to the invention. Plate 50 has a lower surface 56 which is interengagable with the head 26 for mounting plate 50 onto the head. The lower surface is machined to accommodate the particular head to which it is to be attached and may have mounting pads positioned to interengage corresponding existing mounting pads on the head 26. Plate 50 is also drilled to accommodate dowel pins 58 and mounting bolts 60 which provide the means to position and secure the plate 50 to the head.

A first surface portion 62 is arranged opposite to the lower surface 56 and provides a mounting surface for rocker arm stands 54 which support rocker arms 30 which actuate the exhaust valves 16. As seen in the cross-sectional views of FIGS. 4 and 5, rocker arms 30 are rotatably mounted on individual shafts 64 which are fixed to the rocker arm stands 54 by means of nut and bolt fasteners 66. Low friction rotation of the rocker arms is afforded by roller bearings 68 interposed between the shafts 64 and the rocker arms 30. The rocker arms stands are attached to mounting plate 50 by means of bolts 70.

As best seen in FIG. 2A, the first surface portion 62 is preferably angularly oriented with respect to the plane 72 (seen edge on) of the mounting plate 50. The angular orientation allows rocker arm stands 54 to be mounted perpendicularly to the first surface portion 62 and project along an axis 74 extending substantially parallel to the angularly extending centerline 46 of the push rod 34. Axis 74 is also preferably substantially parallel to the centerline 42 of the valve stem 24. This arrangement allows the contact point 40 between the rocker arm and the valve stem to be positioned and maintained substantially coincident with the centerline 42 of the valve stem 24 substantially throughout the motion of the rocker arm 30. The arrangement similarly allows the contact point 44 between the rocker arm and the push rod to be established and maintained substantially coincident with the centerline 46 of the push rod 34 substantially throughout the motion of the rocker arm 30. The angle 76 at which the first surface portion is oriented with respect to the plane 72 of plate 50 is preferably between about 20° to about 40° and most preferably about 23°.

As shown in FIGS. 2 and 3, plate 50 preferably has a second surface portion 78 arranged opposite to the lower surface 56 and in spaced relation to the first surface portion 62. Second surface portion 78 provides a mounting surface for rocker arm stands 52 which support rocker arms 28. Rocker arms 28 actuate the intake valves 14. As seen in the cross-sectional views of FIGS. 6 through 8, rocker arms 28 are rotatably mounted on individual shafts 80 which are fixed to the rocker arm stands 52 by means of nut and bolt fasteners 82. Low friction rotation of the rocker arms is afforded by roller bearings 84 interposed between the shafts 80 and the rocker arms 28. The rocker arms stands 52 are attached to mounting plate 50 by means of bolts 86.

As best seen in FIG. 2A, the second surface portion 78 is preferably angularly oriented with respect to the plane 72 of the mounting plate 50. The angular orientation allows rocker arm stands 52 to be mounted perpendicularly to the second surface portion 78 and project along an axis 88 extending substantially parallel to the angularly extending centerline 90 of the valve stem 22. This arrangement allows the contact point 92 between the rocker arm 28 and the valve stem to be positioned and maintained substantially coincident with the centerline 90 of the valve stem substantially throughout the motion of the rocker arm 28. The angle 94 at which the second surface portion is oriented with respect to the plane 72 of plate 50 is preferably between about 20° to about 40° and most preferably about 35°.

As shown in FIG. 2A, the end of rocker arm 28 which engages the push rod 32 is denoted 28*a* and is arranged at an angle to the opposite end of the rocker arm (denoted 28*b*) which interengages the valve stem.

This angular arrangement of the rocker arm end allows the contact point 96 between the rocker arm end 28*a* and the push rod 32 to be positioned and maintained substantially coincident with the centerline 98 of the push rod.

Also shown in FIG. 2A is an oil distribution tube 100. The oil distribution tube is positioned on plate 50 and carries oil under pressure. The tube 100 has a plurality of apertures 102 oriented to direct a stream of lubricating oil to lubricate the point of contact between the push rod 32 and the rocker arm 28.

When used to form a rocker arm assembly according to the invention, the plate 50 allows the rocker arms 28 and 30 to be mounted on individual rocker arm stands 52 and 54 which can be oriented to ensure that the contact points between the rocker arms and their associated push rods and valve stems are positioned and maintained substantially over the centerlines of the push rods and valve stems. In the rocker arm assembly according to the invention, the lateral motion of the contact points relative to the centerlines is measured to be on the order of 0.001 inches or less throughout the range of motion of the rocker arms, thus, imparting the forces actuating the valves substantially true along the line of motion of the push rods and valves. This arrangement virtually eliminates the side loads experienced by theses parts and secures the following advantages.

The parts such as the push rods and valve stems experience lower forces and stresses, thus, they can be made lighter, will, therefore, reciprocate faster and permit the engine to achieve higher rpms and accelerate more rapidly to the higher rpms.

In the absence of side loads, the parts will experience lower frictional forces and, thus, will be able to move faster with less force, increasing the maximum engine rpm. The parts also will not be subject to increased wear and frequent replacement associated with higher friction levels.

More aggressive cam parameters can be used when the side loads on the parts are not present, thus, increasing the rate of valve opening to maximize engine performance without fear of over stressing and damaging the parts or the engine.

Full advantage can be taken of the rocker arm ratio to magnify the motion of the valves as compared with the motion of the push rods which actuate the valves. The motion of the parts will not be lost due to the trigonometry of the severe angles of a poor valve geometry.

Components associated with individual cylinders, such as a particular valve spring, can be adjusted, tested and replaced without the need to disassemble the entire rocker arm assembly as occurs when the stock rocker arm assembly is used.

The overall engine performance is improved through the use of a rocker arm assembly according to the invention, the engine achieves higher revs, on the order of 9,000 rpm, accelerates through the rpm range at a greater rate and is expected to produce an increase in horsepower on the order of lot.

What is claimed is:

1. A mounting for securing a rocker arm stand to a head of an internal combustion engine, said rocker arm stand having an elongated rocker arm rotatably mounted thereon, said engine comprising a push rod having a centerline extending angularly from said head and interengaging one end of said rocker arm at a point of contact, said mounting comprising a plate having a lower surface interengagable with said head and a first surface portion arranged opposite to said lower surface, said rocker arm stand being mountable on said first surface portion and projecting along an axis extending substantially parallel to said angularly extending centerline of said push rod, said point of contact being substantially coincident with the centerline of said push rod substantially throughout a motion of said rocker arm.

2. A mounting according to claim 1, wherein said first surface portion is angularly oriented with respect to the plane of said plate, said rocker arm stand being mountable substantially perpendicularly to said first surface portion.

3. A mounting according to claim 2, wherein said first surface portion is oriented at an angle between about 20° and about 40° relatively to the plane of said plate.

4. A mounting according to claim 3, wherein said first surface portion is oriented at an angle of about 23° relatively to the plane of said plate.

5. A mounting according to claim 2, wherein said internal combustion engine further comprises a valve stem having a centerline extending angularly from said head and interengaging an other end of said rocker arm at a second point of contact, said second point of contact being substantially coincident with the angularly extending centerline of said valve stem substantially throughout the motion of said rocker arm.

6. A mounting according to claim 5, further comprising a second surface portion positioned on said plate opposite to said lower surface and in spaced relation to said first surface portion, said internal combustion engine having a second valve stem having a centerline extending angularly from said head, and a second rocker arm stand mountable on said second surface portion and projecting along a second axis extending substantially parallel to said angularly extending centerline of said second valve stem, a second elongated rocker arm being rotatably mounted on said second rocker arm stand, said second valve stem interengaging one end of said second rocker arm at a third point of contact, said third point of contact being substantially coincident with the centerline of said second valve stem substantially throughout a motion of said second rocker arm.

7. A mounting according to claim 6, wherein said second surface portion is angularly oriented with respect to the plane of said plate, said second rocker arm stand being mounted substantially perpendicularly to said second surface portion.

8. A mounting according to claim 7, wherein said second surface portion is oriented at an angle between 20° and 40° relatively to the plane of said plate.

9. A mounting according to claim 8, wherein said second surface portion is angularly oriented at an angle of about 35° relatively to the plane of said plate.

10. A mounting according to claim 7, wherein said internal combustion engine further comprises a second push rod having a centerline extending angularly from said head and interengaging an other end of said second rocker arm at a fourth point of contact, said fourth point of contact being substantially coincident with the centerline of said second push rod substantially throughout the motion of said second rocker arm.

11. A mounting according to claim 10, wherein said lower surface is interengagable with a head of an engine having hemispherical combustion chambers.

12. A plate according to claim 10, further comprising an oil distribution tube mounted on said plate adjacent to one of said first and second surface portions beneath said rocker arms, said oil distribution tube carrying lubricating oil under pressure and having an aperture oriented to direct a stream of said lubricating oil to lubricate said point of contact between one of said first and second push rods and said first and second rocker arms.

13. A rocker arm assembly mountable on the head of an internal combustion engine having a plurality of first push rods, each first push rod having a centerline extending angularly outwardly from said head, said rocker arm assembly comprising:

a plate having a lower surface interengagable with said head and a first surface portion arranged opposite to said lower surface;

a plurality of first rocker arm stands mounted on said first surface portion, each first rocker arm stand being angularly oriented substantially parallel to said centerline of a respective first push rod;

a plurality of first elongated rocker arms, each being rotatably mounted on a respective first rocker arm stand, one end of each first rocker arm interengaging a respective first push rod at a point of contact substantially coincident with said centerline of said respective first push rod; and means for securing said plate to said head.

14. A rocker arm assembly according to claim 13, wherein said first surface portion is angularly oriented substantially perpendicularly to said plurality of first push rods, said plurality of first rocker arm stands being mounted substantially perpendicularly to said first surface portion.

15. A rocker arm assembly according to claim 14, wherein said first surface portion is angularly oriented at an angle between about 20° and 40° relative to the plane of said plate.

16. A rocker arm assembly according to claim 15, wherein said first surface portion is angularly oriented at an angle of about 23° relative to the plane of said plate.

17. A rocker arm assembly according to claim 14, wherein said engine further comprises a plurality of first valve stems, each having a centerline extending angularly outwardly from said head, an other end of each first rocker arm being interengaged with a respective first valve stem at a second point of contact substantially coincident with said centerline of said respective first valve stem.

18. A rocker arm assembly according to claim 17, wherein each first valve stem extends from a respective exhaust valve.

19. A rocker arm assembly according to claim 17, wherein said engine has a plurality of second valve stems, each having a centerline extending angularly outwardly from said head, said assembly further comprising:

a second surface portion arranged on said plate opposite to said lower surface and positioned in spaced relation to said first surface portion;

a plurality of second rocker arm stands mounted on said second surface portion, each second rocker arm stand being angularly oriented substantially parallel to said centerline of a respective second valve stem;

a plurality of second rocker arms each being rotatably mounted on a respective second rocker arm stand, one end of each second rocker arm interengaging a respective second valve stem at a third point of contact, said third point of contact being substantially coincident with said centerline of said respective second valve stem.

20. A rocker arm assembly according to claim 19, wherein said second surface portion is angularly oriented substantially perpendicularly to said centerlines of said second valve stems, said plurality of second rocker arm stands being mounted substantially perpendicularly to said second surface portion.

21. A rocker arm assembly according to claim 20, wherein said second surface portion is angularly oriented at an angle between about 20° and 40° relative to the plane of said plate.

22. A rocker arm assembly according to claim 20, wherein said second surface portion is angularly oriented at an angle of about 35° relative to the plane of said plate.

23. A rocker arm assembly according to claim 19, wherein each second valve stem extends from a respective intake valve.

24. A rocker arm assembly according to claim 19, wherein said engine further comprises a plurality of second push rods each having a centerline extending angularly outwardly from said head, an other end of each second rocker arm interengaging a respective second push rod at a fourth point of contact, said fourth point of contact being substantially coincident with said centerline of said respective second push rod.

25. A rocker arm assembly according to claim 20, wherein said lower surface is interengagable with a head of an engine having hemispherical combustion chambers.

26. A mounting for securing a rocker arm stand to a head of an internal combustion engine, said rocker arm stand having an elongated rocker arm rotatably mounted thereon, said engine comprising a push rod having a centerline extending angularly outwardly from said head and interengaging one end of said rocker arm at a first point of contact and a valve stem having a centerline extending angularly outwardly from said head and interengaging the other end of said rocker arm at a second point of contact, said mounting comprising a plate having a lower surface interengagable with said head and a first surface portion arranged opposite to said lower surface, said rocker arm stand being mountable on said first surface portion.

27. A mounting according to claim 26, wherein said first point of contact is substantially coincident with the centerline of said push rod and said second point of contact is substantially coincident with the centerline of said valve stem substantially throughout a motion of said rocker arm.

28. A mounting according to claim 27, wherein said first surface portion is angularly oriented with respect to the plane of said plate, said rocker arm stand being mountable substantially perpendicularly to said first surface portion.

29. A mounting according to claim 28, wherein said first surface portion is oriented at an angle between about 20 degrees and about 40° relatively to the plane of said plate.

30. A mounting according to claim 29, wherein said first surface portion is oriented at an angle of about 23° relatively to the plane of said plate.

31. A mounting according to claim 28, further comprising a second surface portion positioned on said plate opposite to said lower surface and in spaced relation to said first surface portion, said engine having a second valve stem having a centerline extending angularly outwardly from said head, a second push rod having a centerline extending angularly outwardly from said head, a second rocker arm stand mountable on said second surface portion, and a second elongated rocker arm rotatably mounted on said second rocker arm stand, said second valve stem interengaging one end of said second rocker arm at a third point of contact, said second push rod interengaging an other end of said second rocker arm at a fourth point of contact, said third point of contact being substantially coincident with the centerline of said second valve stem and said fourth point of contact being substantially coincident with the centerline of said second push rod substantially throughout a motion of said second rocker arm.

32. A mounting according to claim 31, wherein said second surface portion is angularly oriented with respect to the plane of said plate, said second rocker arm stand being mounted substantially perpendicularly to said second surface portion.

33. A mounting according to claim 32, wherein said second surface portion is oriented at an angle between 20° and 40° relatively to the plane of said plate.

34. A mounting according to claim 33, wherein said second surface portion is angularly oriented at an angle of about 35° relatively to the plane of said plate.

* * * * *